US005833357A

United States Patent [19]

Ting

[11] Patent Number: 5,833,357

[45] Date of Patent: Nov. 10, 1998

[54] TROUBLE LIGHT

[76] Inventor: Lin Chien Ting, No. 40, Lane 193, Hang Sheng East Road, Taipei Hsien, Taiwan

[21] Appl. No.: 698,388

[22] Filed: Aug. 15, 1996

[51] Int. Cl.[6] ..... F21V 15/02; F21V 21/00; H01R 11/00

[52] U.S. Cl. ..... 362/378; 362/376; 439/654; 439/502; 439/505; 439/650

[58] Field of Search ..... 362/376, 378; 439/645, 646, 654, 502, 505, 638, 650

[56] References Cited

U.S. PATENT DOCUMENTS

| | | | |
|---|---|---|---|
| 2,554,565 | 5/1951 | Fike | 362/376 |
| 2,774,048 | 12/1956 | Baenziger | 362/378 |
| 3,584,213 | 6/1971 | Meltzer | 240/54 |
| 3,668,602 | 6/1972 | Griffin | 339/14 R |
| 3,755,668 | 8/1973 | Moreschini | 240/54 A |
| 3,835,311 | 9/1974 | Kramer | 240/54 R |
| 4,019,047 | 4/1977 | Frey | 362/257 |
| 4,275,435 | 6/1981 | Dorn | 362/368 |
| 4,369,487 | 1/1983 | Carlow | 362/258 |
| 4,644,456 | 2/1987 | Lydell | 362/376 |
| 4,774,647 | 9/1988 | Kovacik et al. | 362/295 |
| 4,864,477 | 9/1989 | Engelman | 362/376 |
| 5,369,559 | 11/1994 | Hedrick et al. | 362/376 |

*Primary Examiner*—Ira S. Lazarus
*Assistant Examiner*—Nhat-Hang H. Lam
*Attorney, Agent, or Firm*—Gifford, Krass, Groh, Sprinkle, Patmore, Anderson&Citkowski

[57] ABSTRACT

The present invention improves upon existing trouble lights by providing a multi-purpose trouble light having a handle upon which are positioned two electrical receptacles suitable for engagement with standard electrical plugs of the type having two flat male blades and a cylindrical male pin positioned in a standard triangular configuration. The electrical plugs are inserted into the receptacles in the handle inverted with respect to each other. A first and second female terminals and a ground terminal are positioned within the trouble light. The first and second female terminals, each having two channels, are positioned within the handle so that each male blade of the two electrical plugs is received within one of the channels. The third terminal provides a ground connection for the cylindrical male pins of the electrical plugs. This efficient and compact terminal configuration enables two electrical receptacles to be provided in a compact and conveniently-sized handle.

6 Claims, 4 Drawing Sheets

TROUBLE LIGHT

FIELD OF THE INVENTION

This invention relates generally to trouble lights, and more particularly to a trouble light having two complementary electrical plugs.

BACKGROUND OF THE INVENTION

When working in remote areas, it is important to have sufficient light and access to a power source such as an electrical outlet. Typically, trouble lights of the type having a cage surrounding a bulb which is supported on a handle are utilized to provide light to the work area. Trouble lights are frequently equipped with long electrical cords due to the unavailability of nearby power sources. Frequently, power tools must also be utilized in these remote work areas and long electrical extension cords are utilized to bring power to the work area. It is preferable to limit the number of long electrical extension cords within a work area, as each cord adds unnecessary clutter to the work area and increases the opportunity for tripping and falling.

A current disadvantage of existing trouble lights is that while they provide light to a remote work area, they decrease the number of available electrical outlets for use by power tools. As noted above, it is disadvantageous to provide several extension cords to increase the number of available electrical outlets in the remote work area.

U.S. Pat. No. 5,452,194 to Phalen discloses a cordless trouble light with a cage surrounding the light source comprising a handle having positioned at its lower end a plug with three prongs suitable for engagement with an extension cord. The user must connect an electrical extension cord to the cordless trouble light disclosed by Phalen prior to use. While the device disclosed by Phalen enables a user to have access to any additional unused receptacles present on the extension cord, the Phalen device does not itself provide additional receptacles suitable for engagement with standard electrical plugs having a triangular configuration such as those utilized on power tool cords.

U.S. Pat. No. 5,369,559 to Hedrick et al discloses a trouble light assembly which includes a handle portion having a male conductor plug, which is in electrical communication with the bulb, disposed therein. A door in the handle portion opens to permit the female receptacle of an extension cord to be matingly engaged with the male conductor plug so as to establish an electrical connection between the male conductor plug and the extension cord. After mating the electrical extension cord to the male conductor plug, the door is closed, thereby prohibiting the use of any additional available outlets positioned on the electrical extension cord.

The unresolved problem with existing trouble lights is resolved by the present invention which provides a multi-purpose trouble light having two complementary electrical receptacles, each receptacle suitable for engagement with a standard electrical plug of the type having two flat male blades and a cylindrical male pin positioned in a standard triangular configuration.

SUMMARY OF THE INVENTION

The present invention improves upon existing trouble lights by providing a multi-purpose trouble light having a handle upon which are positioned a first and second electrical receptacle, each receptacle suitable for engagment with a standard electrical plug of the type having two flat male blades and a cylindrical male pin positioned in a standard triangular configuration. The electrical plugs are inserted into the receptacles in the handle inverted with respect to each other, the first plug being inserted into the first receptacle so that the cylindrical male pin is positioned below the two flat male blades, the second plug being inserted into the second receptacle so that the cylindrical male pin is positioned above the two flat male blades. Three electrically conductive terminals are positioned within the handle of the trouble light and are in electrical communication with an external power source such as a wall outlet. The three terminals include a first and second female terminals and a ground terminal. The first and second female terminals, each having an upper channel and a lower channel, are positioned within the handle so that each male blade of the two electrical plugs is received within one of the channels on the first or second female terminal. The third terminal provides a ground connection for the cylindrical male pins of the electrical plugs. This efficient and compact terminal configuration enables two electrical receptacles to be provided in a compact and conveniently-sized handle.

Alternate embodiments of the present invention may include extension cords or other appliances having a plurality of outlets, each outlet accepting an electrical plug of the type having three prongs as described above, the electrical plugs inserted into the outlets in an inverted fashion such that, with the plugs inserted, the male ground pin of each plug is situated between the flat male blades of another electrical plug.

Other objects, advantages and applications of the present invention will be made clear by the following detailed description of a preferred embodiment of the invention. The description makes reference to drawings in which:

DETAILED DESCRIPTION OF THE PREFERRED EMBODIMENT

The present invention is directed to a multi-purpose trouble light having a handle portion having disposed thereupon two electrical receptacles suitable for engagement with standard electrical plugs having three terminals positioned in a triangular configuration. The present invention accommodates two electrical receptacles on a single, compact handle by configuring the terminals of the receptacle so that the standard electrical plugs are inserted into the handle in an inverted fashion with respect to each other.

Figure 1:
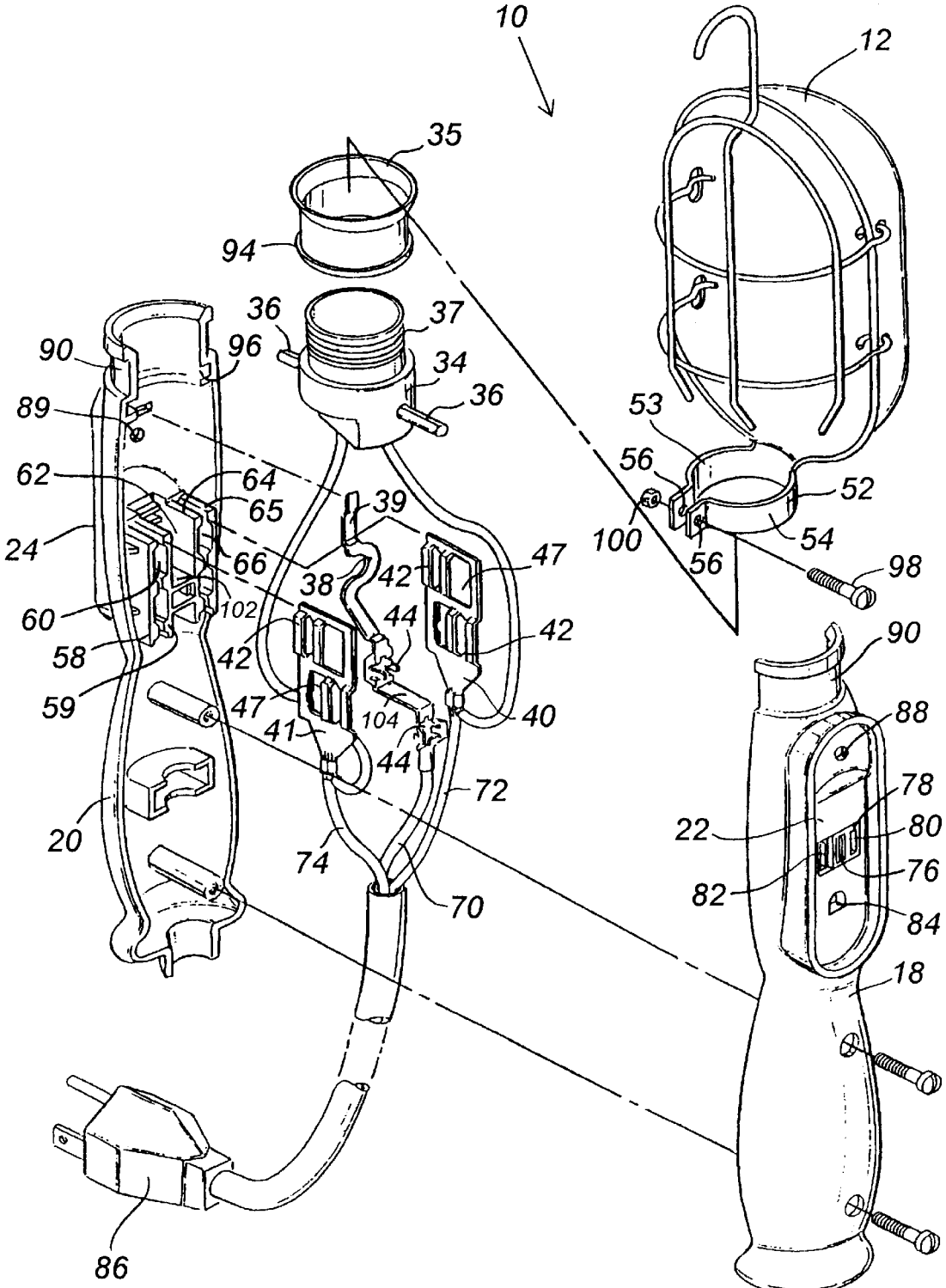
FIG. 1 is an exploded view of the preferred embodiment of the present invention.

The invention, generally depicted at 10 in FIG. 1, comprises a housing 16 having a first portion 18 and a second portion 20, the housing 16 forming a handle for the trouble light 10. A generally cylindrical cage 12, preferably formed of a metal such as steel or aluminum, is mounted to the upper end of handle 16 by a clasp 52 which is preferably integrally formed on the lower end of cage 12. Clasp 52, preferably formed of a metal such as steel or aluminum, comprises a pair of flexible members 53 and 54 which extend outwardly from the lower end of shield 12 to encompass the recess 90 of first housing portion 18 and second housing portion 20. A pair of holes 56 are positioned proximate to the end of flexible members 53 and 54 of clasp 52. In the preferred embodiment, a bolt 98 and a nut 100 are used to secure cage 12 to housing 16. In alternate embodiments, other connecting means may be utilized to secure flexible members 53 and 54 together such as riveting, spot welding and gluing.

A bulb 14 is threadably inserted into bulb receptacle 34, which is operatively electrically connected to plug 86 which is suitable for insertion into an external power source such as a wall socket. Bulb receptacle 34 includes an on/off switch 36 which is operatively positioned therein, enabling a user to turn bulb 14 on and off. Bulb receptacle 34 preferably is inserted into non-conductive collar 35 having a lower rib 94 extending about the perimeter of collar 35. Lower rib 94 is received within groove 96 positioned proximate to the upper ends of housing portions 18 and 20. On/off switch 36 extends through hole 89 in housing portion 20 and hole 88 is housing portion 18. In alternate embodiments, on/off switch 36 may also switch off the current to either one or both of the receptacles.

Figure 2:
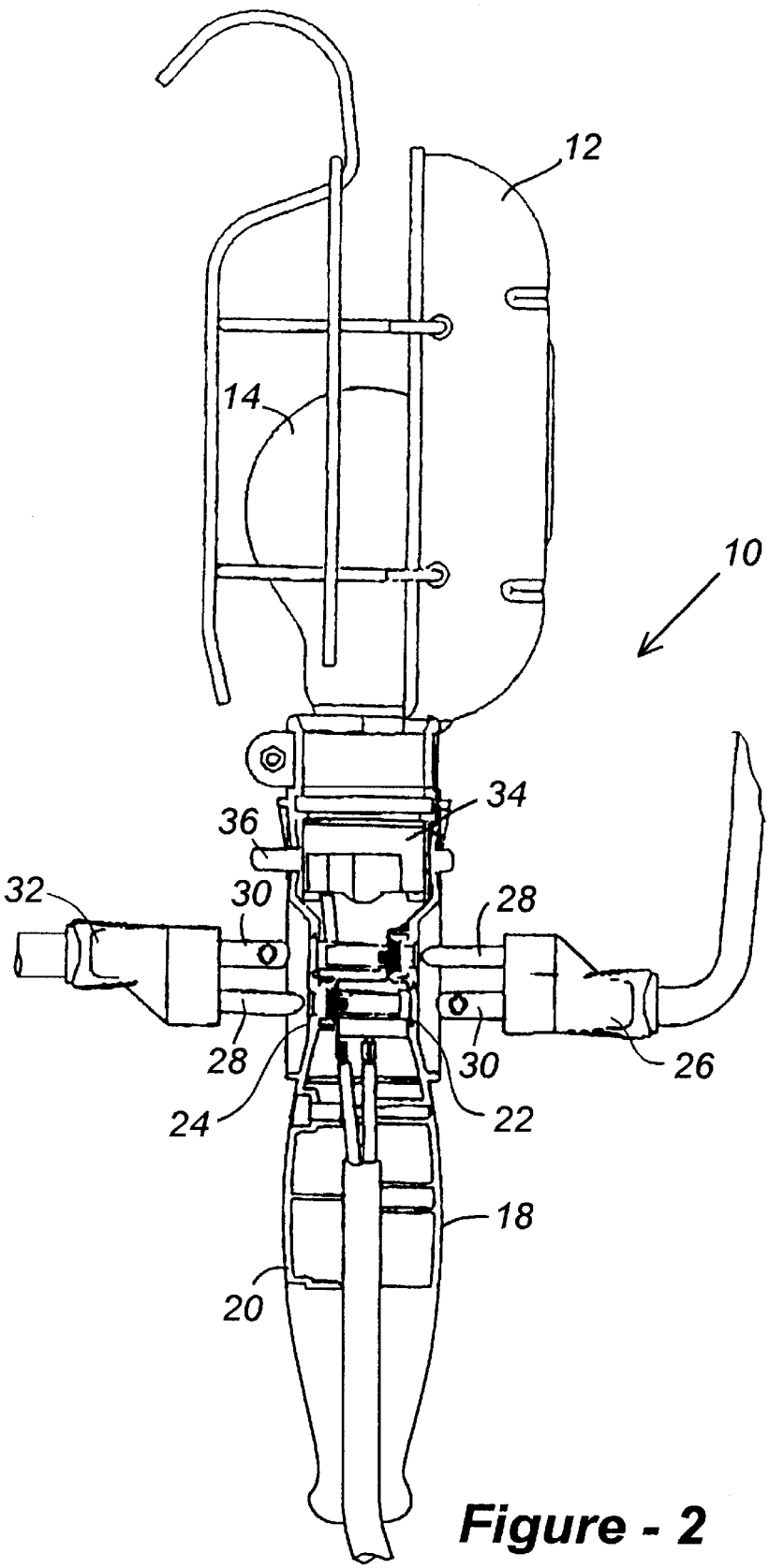
FIG. 2 is a partial cross-sectional view of the preferred embodiment.

A first electrical receptacle 22 is positioned on first housing portion 18, and a second electrical receptacle 24 is positioned on second housing portion 20. Receptacles 22 and 24 are each configured to receive a standard electrical plug having two flat male blades (otherwise referred to as spade terminals) 30 and one cylindrical male ground pin 28. As shown in FIG. 2, receptacles 22 and 24 are configured so that first electrical plug 26 is inserted into receptacle 22 with cylindrical male ground pin 28 being positioned above flat male blades 30. Second electrical plug 32 is inserted into receptacle 24 so that cylindrical male ground pin 28 is positioned below flat male blades 30. By aligning receptacles 22 and 24 so, upon insertion, the first and second electrical plugs are inverted relative to one another, a compact arrangement of electrically conductive terminals may be utilized within housing 16 to provide electrical connections for the two electrical plugs, thus enabling a more efficient and economical use of the space within housing 16.

In the preferred embodiment of the present invention, three electrically conductive terminals are positioned within housing 16 and are in electrical communication with an external power source such as a wall outlet. Two female terminals 40 and 41 and a ground terminal 38 are preferably disposed within housing 16 and are each electrically connected to wires 72, 74 and 70, respectively, by mechanical crimping or other attachment means such as welding. Electrical power is provided to trouble light 10 via wires 70, 72 and 74 which terminate, at their other end, in a standard electrical plug 86 which is suitable for insertion into an electrical receptacle such as a wall socket.

Ground terminal 38 is configured to function as an electrical ground to both cylindrical male pins 28 of the plugs 26 and 32 and is preferably formed of an electrically conductive metal such as bronze. FIG. 1 illustrates the placement of ground terminal 38, the upper end 39 of ground terminal 38 being received exteriorly of housing portion 20 so that ground terminal 38 is in electrical connection with flexible members 53 and 54 of clasp 52. Ground terminal 38 is primarily positioned within housing 20 in recess 62 formed by ribs 59 and 64 so that the generally horizontal portion 104 of ground terminal 38 is supported by the generally horizontal surface 102.

Figure 5:
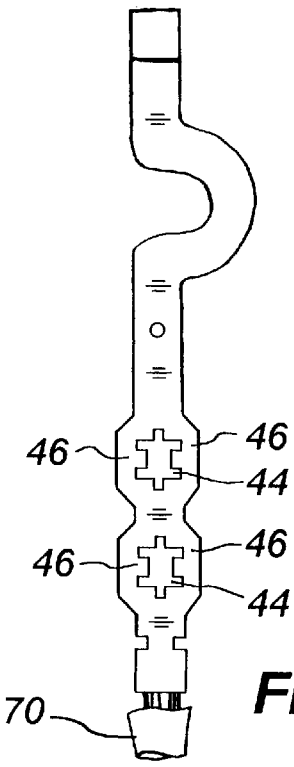
FIG. 5 is a front view of the ground terminal enclosed in the handle of the trouble light.
Figure 6:
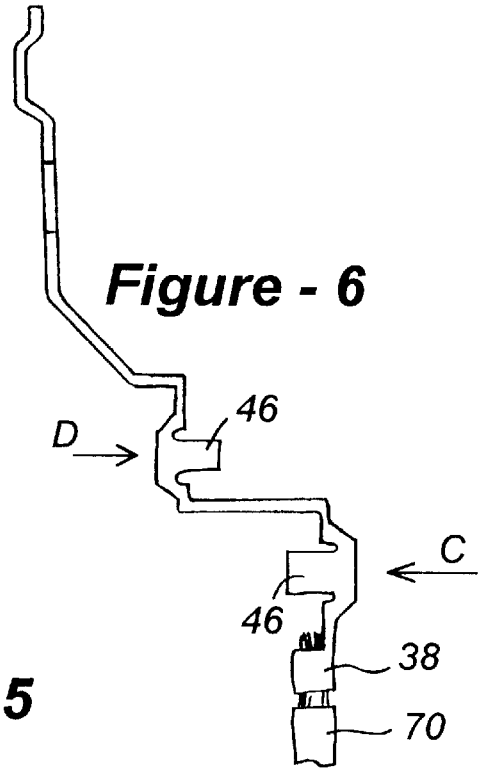
FIG. 6 is a side view of the ground terminal depicted in FIG. 5.

As best shown in FIGS. 5 and 6, ground terminal 38 has two apertures 44 through which cylindrical male pins 28 are inserted in the direction indicated by arrows C and D. Ground terminal 38 is positioned within housing 16 so that apertures 44 are aligned with apertures 84 through which cylindrical male pins 28 are inserted. A pair of projecting tabs 46 are positioned along the perimeter of apertures 44 and extend from ground terminal 38 in the direction of insertion of cylindrical male pins 28, as indicated by arrows C and D in FIGS. 5 and 6. Tabs 46 and apertures 44 are configured to ensure electrical contact between cylindrical male pins 28 and ground terminal 38.

Two female terminals 40 and 41 are also enclosed within housing 16 and are preferably formed of an electrically conductive metal such as bronze. As shown in FIG. 1, female terminal 40 is slidably received within cavity 66 formed by ribs 64 and 65, and female terminal 41 is slidably received within cavity 60 formed by ribs 58 and 59. In the preferred embodiment, the female terminals 40 and 41 are substantially identical, each female terminal having an upper portion 50 and a lower portion 51.

Figure 3:
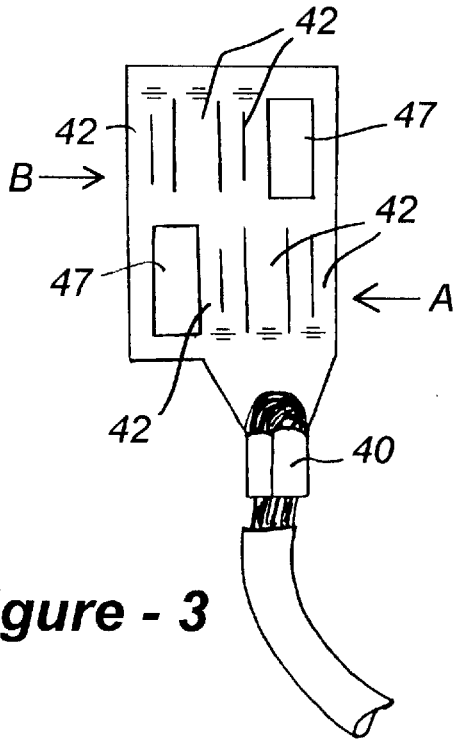
FIG. 3 is a front view of the female terminal enclosed in the handle of the trouble light.
Figure 4:
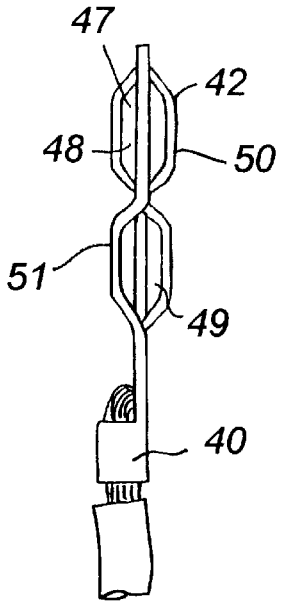
FIG. 4 is a side view of the female terminal depicted in FIG. 3.

A cutout 47 and a plurality of outwardly extending ribs 42 are positioned on the upper and lower portions 50 and 51 of the female terminals. In the preferred embodiment depicted in FIGS. 3 and 4, three ribs 42 are positioned on the upper portion 50 and three ribs 42 are positioned on the lower portion 51. As best shown in FIG. 4, the ribs 42 extend outwardly from the female terminal 40 in an opposing fashion, two ribs 42 extend in one direction while the third rib, disposed between the other two ribs, extends in the opposite direction to form a channel suitable to receive one male blade 30.

Ribs 42 form an upper channel 48 on the upper portion 50 and a lower channel 49 on the lower portion 51. As seen in the embodiment depicted in FIG. 5, lower channel 49 is configured to receive one flat male blade 30 which would be inserted into channel 49 from the direction of the viewer's perspective. The upper channel 48 is adapted to receive one flat male blade 30 which would be inserted from the direction opposite to the viewer's perspective. As shown in FIG. 4, one flat male blade 30 is inserted into channel 49 in the direction of arrow A, and another flat male blade 30 is inserted into channel 48 in the direction of arrow B. In the preferred embodiment, ribs 42 on female terminals 40 and 41 have slightly contoured surfaces to enhance electrical communication between the male blades 30 and female terminals 40 and 41.

In a preferred embodiment of the present invention, a sliding member 76 having a slot 78 positioned proximate to one end of sliding member 76, is depicted in FIG. 1 and is positioned across the apertures 80 and 82 of the receptacles which receive the two spaced apart flat male blades 30. The sliding member 76 is enclosed in a recessed channel and has a first and second position. When sliding member 76 is in its first position, slot 78 is aligned with aperture 80, the end of sliding member 76 being positioned between apertures 80 and 82 thus permitting insertion of an electrical plug therein. When the sliding member is moved to its second position within the channel, the sliding member 76 covers apertures 80 and 82, thus preventing insertion of an electrical plug into the receptacle. In alternate embodiments, other means may be provided to prevent insertion of electrical plugs into the receptacles, such as a plastic cover having projections which are insertable into apertures 80 and 82.

Figure 7:
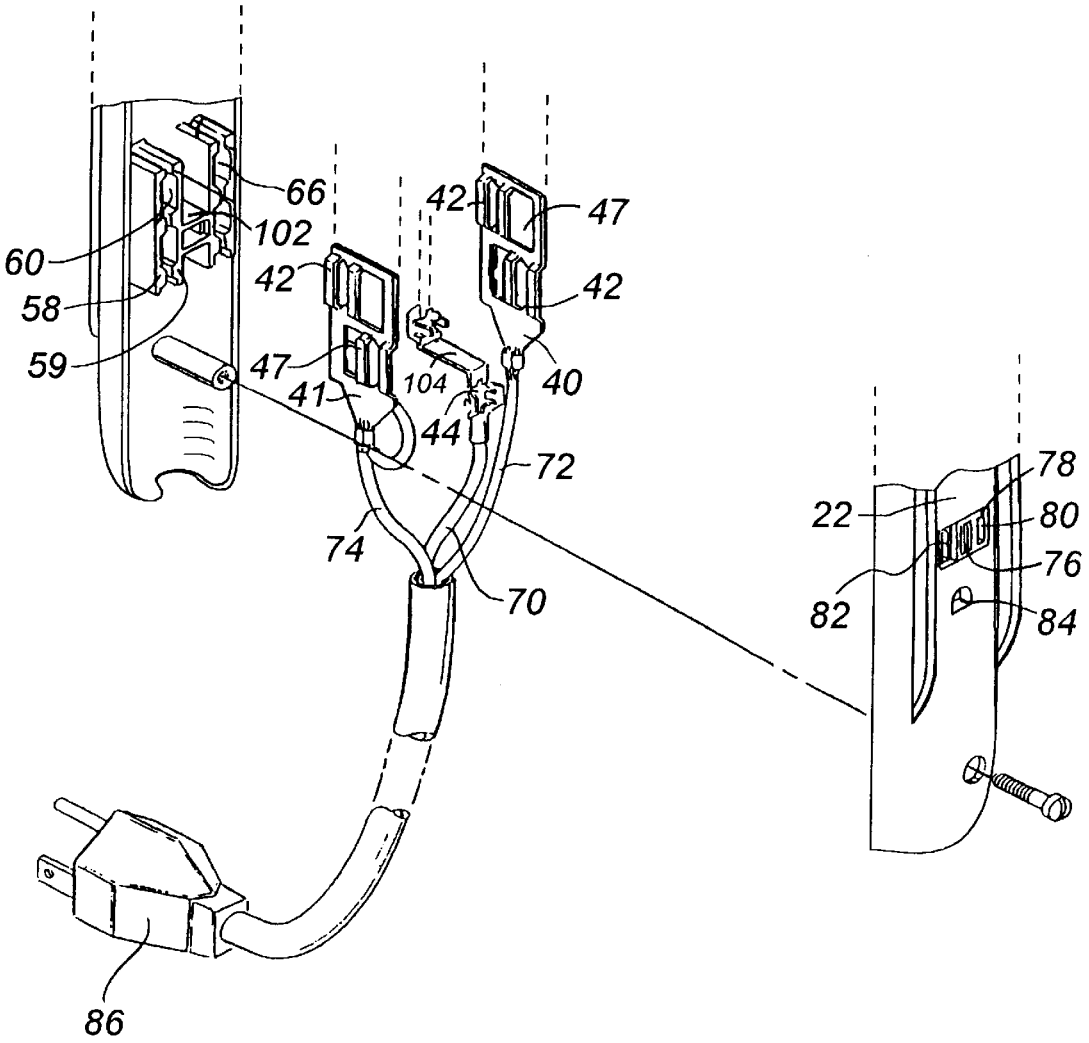
FIG. 7 is an exploded view of an alternate embodiment of the present invention.

Alternate embodiments of the present invention, such as the extension cord depicted in FIG. 7, may include electrical devices or appliances having a plurality of outlets, each outlet accepting an electrical plug of the type having three prongs as described above, the electrical plugs inserted into the outlets in an inverted fashion such that, with the plugs inserted, the male ground pin of each plug is situated between the flat male blades of another electrical plug.

Having described the various embodiments of the present invention with reference to the accompanying figures, it will be appreciated that various changes and modifications can be made without departing from the scope or spirit of the invention.

I claim:

1. In an appliance having a body with a plurality electrical outlets, each of which accepts a three-prong plug with two spade terminals and a ground prong, the improvement comprising:

an electrical conductor structure within the body enabling two opposing plugs to be inserted toward one another in respective outlets on opposite sides of the body in inverted fashion, such that, with both plugs inserted, the ground prong of each plug is situated between the two spade terminals of the other plug.

2. The improvement of claim 1, wherein the appliance is a trouble light and the body is the handle thereof.

3. The improvement of claim 1, wherein the appliance is an extension cord and the body is attached to the receptacle end of the cord.

4. The improvement of claim 1, wherein the electrical conductor structure within the body of the appliance further includes:

two opposing electrically conductive female electrode plates, each having a plurality of formed ribs to receive one spade terminal from each of the plugs; and a bent electrical conductor disposed between the plates, the bent electrical conductor including two apertures to receive the ground prongs of each plug.

5. A trouble light, comprising:

a handle physically connecting an electrical cord to a lamp socket, the handle having a pair of electrical outlets, each of which accepts a three-prong plug with two spade terminals and a ground prong; and an electrical conductor structure within the handle enabling the outlets to be configured such that two opposing plugs may be inserted respectively thereinto toward one another on opposite sides of the handle in inverted fashion, such that, with both plugs inserted, the ground prong of each plug is situated between the two spade terminals of the other plug.

6. A trouble light, comprising:

a housing having an interior cavity, an upper end and a lower end;

a light bulb shield having a clasp, the clasp being affixed to the upper end of the housing;

an electrically conductive bulb receptacle suitable for receiving a light bulb, the electrically conductive bulb receptacle positioned substantially within the interior cavity of the housing proximate to the upper end of the housing, the bulb receptacle accessible from exteriorly of the housing;

an off/off switch in operative electrical communication with the bulb receptacle and an external power source, the on/off switch having a first position which permits the flow of electrical current through the switch and the bulb receptacle so as to illuminate the light bulb, the on/off switch having a second position which prevents the flow of electrical current through the switch and the bulb receptacle so as to prevent the illumination of the light bulb;

a first plug receptacle positioned on the exterior surface of the housing, the first plug receptacle being configured to accept a first electrical plug of the type having two flat male blades spaced apart from each other and a cylindrical male pin positioned below the two flat male blades in substantially a triangular configuration;

a second plug receptacle positioned on the exterior surface of the housing, the second receptacle being substantially directly opposite the first receptacle, the second plug receptacle being configured to accept a second electrical plug of the type having two flat male blades spaced apart from each other and a cylindrical male pin positioned below the two flat male blades in substantially an inverted triangular configuration;

two female terminals positioned within the interior of the housing, the two female terminals in operative electrical communication with the external power source, each female terminal having a plurality of ribs which extend outwardly from the terminal so as to form an upper channel and a lower channel, each channel configured to receive and maintain electrical contact with one of the flat male blades of the first and/or second electrical plugs; and a ground terminal having two apertures, the ground terminal positioned within the interior of the housing, each aperture configured to receive the cylindrical male pin of the first and/or second electrical plug, the ground terminal in operative electrical communication with the external power source, whereby the first and second plugs may be inserted into the first and second plug receptacles, respectively, the flat male blades of the first plug being in electrical communication with one of the female terminals, the flat male blades of the second plug being in electrical communication with the other female terminal, the ground terminal in electrical communication with the cylindrical male pins of the first and second electrical plugs.

* * * * *